US005157368A

United States Patent [19]

Okano et al.

[11] Patent Number: 5,157,368

[45] Date of Patent: Oct. 20, 1992

[54] THIN TYPE TRANSFORMER

[75] Inventors: Kohei Okano; Minoru Noguchi, both of Sakado, Japan

[73] Assignee: Tamura Corporation, Tokyo, Japan

[21] Appl. No.: 650,633

[22] Filed: Feb. 5, 1991

[30] Foreign Application Priority Data

Feb. 9, 1990 [JP] Japan ..... 2-31027

[51] Int. Cl.[5] ..... H01F 27/02; H01F 15/10; H01F 27/30

[52] U.S. Cl. ..... 336/90; 336/192; 336/198

[58] Field of Search ..... 336/198, 208, 90, 92, 336/96, 98, 192, 65

[56] References Cited

U.S. PATENT DOCUMENTS

| | | | |
|---|---|---|---|
| 3,112,898 | 12/1963 | Stahl | 336/198 X |
| 4,075,590 | 2/1978 | Foldes | 336/198 X |
| 4,318,067 | 3/1982 | Weiner | 336/98 X |
| 4,363,014 | 12/1982 | Leach et al. | 336/90 |

FOREIGN PATENT DOCUMENTS

| | | | |
|---|---|---|---|
| 2500293 | 8/1976 | Fed. Rep. of Germany | 336/198 |
| 61-168617 | 10/1986 | Japan | 336/198 |

OTHER PUBLICATIONS

IBM Technical Disclosure Bulletin, vol. 30, No. 11, Apr. 1988, "Bobbin Set for a Low Profile, Safety Approved Transformer" pp. 58.

*Primary Examiner*—Thomas J. Kozma
*Attorney, Agent, or Firm*—Leydig, Voit & Mayer

[57] ABSTRACT

A thin type transformer has a coil bobbin with a coil wound on a flat and hollow barrel part of the bobbin, and a core mounted to the bobbin with a central leg portion of the core passed through the barrel part. Further, a pair of core cover members adapted to be mutually fittable while enclosing the core are mounted to the transformer as fitted and coupled to each other through engaging parts of the cover members, whereby constituent elements can be simplified while improving effectively the assembling and mass-producing ability.

4 Claims, 3 Drawing Sheets 11
12
13
14
15
15a
15b
16
16a
16b
17b
18a
18b
19
20
20a
20b
20c
20d
21
22
22a
22b
22c
22d
22e
22g
22h
22i
23
23a
23b
23c
23d
23e
23g
23h
23i

THIN TYPE TRANSFORMER

BACKGROUND OF THE INVENTION

This invention relates to thin type transformers for use in communication devices and equipments.

The thin type transformers of the kind referred to are extremely useful when employed as provided, for example, on wiring substrates to be in line transformers in a network control unit for modems.

DESCRIPTION OF RELATED ART

Generally, such a transformer comprises a coil bobbin having connection terminals, a core mounted axially through the coil bobbin, and a coil wound on the bobbin, in which arrangement it has been demanded that, for attaining a sufficient dielectric strength between the core mounted in the coil bobbin and the terminals, a sufficiently large creepage distance is maintained.

In Japanese Laid-Open Utility Model Publication No. 61-168617 of Senji Kato, for example, there has been disclosed a thin type transformer in which an insulating cover adapted to be disposed between the core and the terminals for providing a sufficiently large creepage distance therebetween is fitted to the coil bobbin, with the core assembled with the bobbin on the other side of the cover than that of the terminals. According to this known transformer, a certain extent of creepage distance may be secured between the core and the terminals, but the insulating cover is insufficient in mechanical strength so that there arise such drawbacks that the insulating cover is likely to be easily broken when the core is assembled, and mutual coupling of the coil bobbin, insulating cover and core is required to be performed respectively separately, so as to be more difficult to assemble.

SUMMARY OF THE INVENTION

A primary object of the present invention is, therefore, to provide a thin type transformer which is capable of solving the foregoing drawbacks and is excellent in the yield of products upon assembling while securing a sufficiently large creepage distance.

It is another object of the present invention to provide a thin type transformer which comprises simpler constituent elements which enhance the assemling-ability to be excellent and the mass-productivity to be high.

A further object of the present invention is to provide a thin type transformer in which a cover is provided for covering peripheral surfaces of the core so that electric connections on the wiring substrate, wirings with respect to the transformer terminals and the like portions can be prevented from being damaged when the core is assembled to the coil bobbin.

Other objects and advantages of the present invention shall be made clear in following description of the invention detailed with reference to a preferred embodiment shown in accompanying drawings.

While the present invention shall now be described in the followings with reference to the embodiment shown, it should be appreciated that the intention is not to limit the invention only to the embodiment shown, but rather to include all alterations, modifications and equivalent arrangements possible within the scope of appended claims.

DETAILED DESCRIPTION OF THE PREFERRED EMBODIMENT

Figure 1:
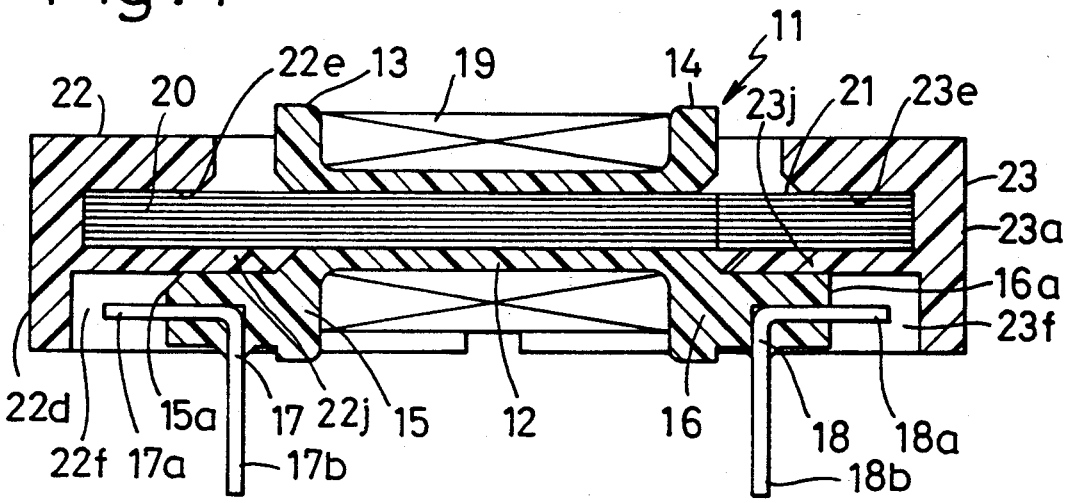
FIG. 1 is a sectioned view as magnified of a thin type transformer according to the present invention.
Figures 2, 3, 4:
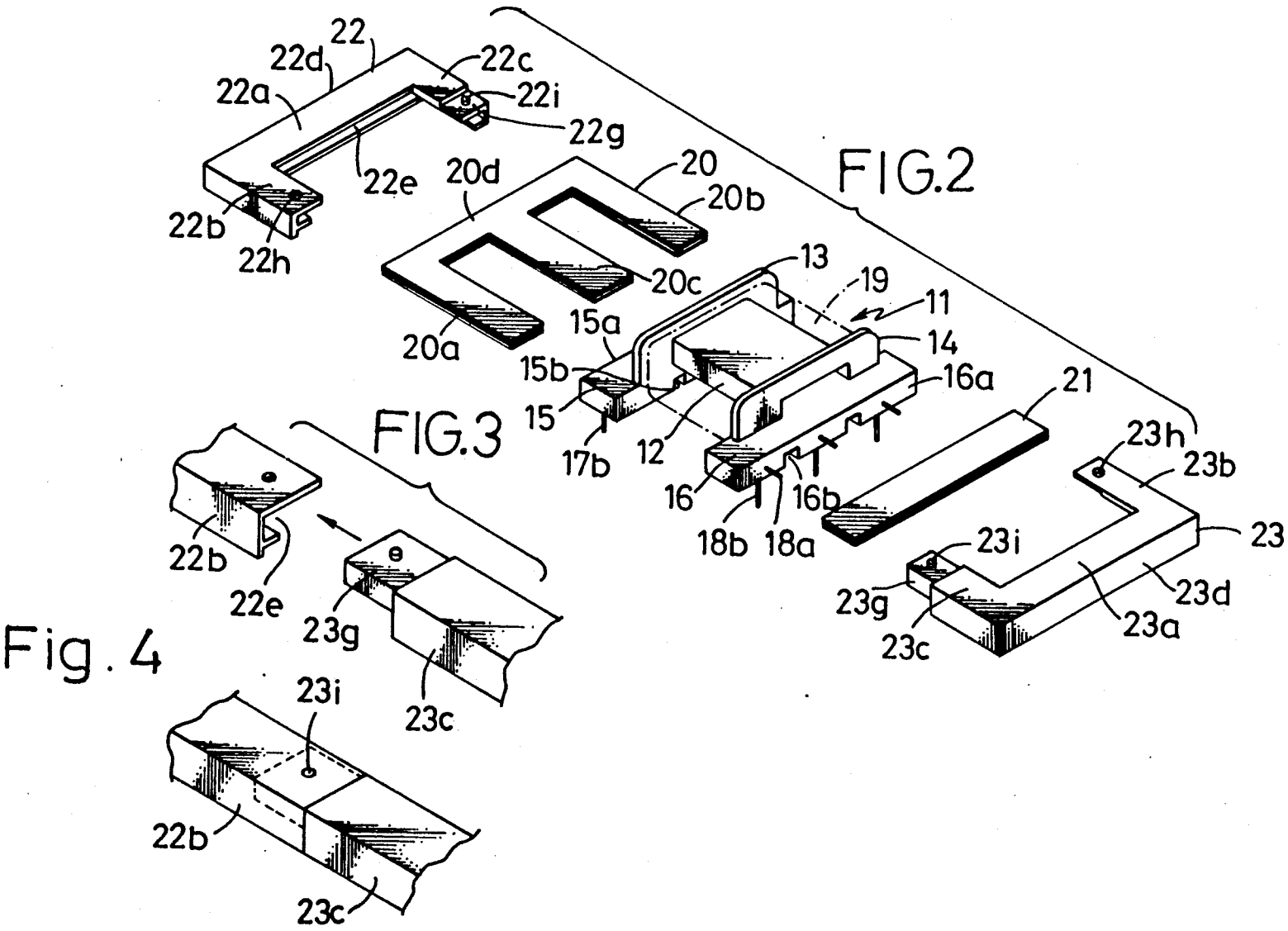
FIG. 2 shows in a perspective view as disassembled the transformer of FIG. 1.
FIG. 3 is a fragmentary perspective view as magnified of coupling parts of a pair of core cover members in the transformer of FIG. 1, before being coupled.
FIG. 4 shows also in a fragmentary perspective view the coupling parts as coupled to each other of the pair of core cover members in the transformer of FIG. 1.
Figure 10:
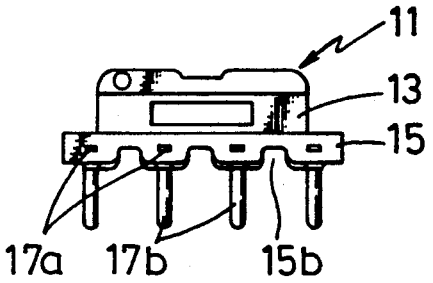
FIG. 10 is one end elevation of a coil bobbin in the transformer shown in FIG. 1.
Figure 11:
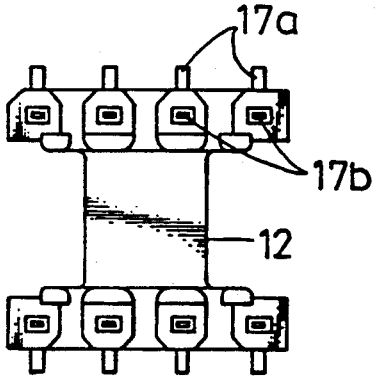
FIG. 11 is a top plan view of the coil bobbin of FIG. 10.
Figure 12:
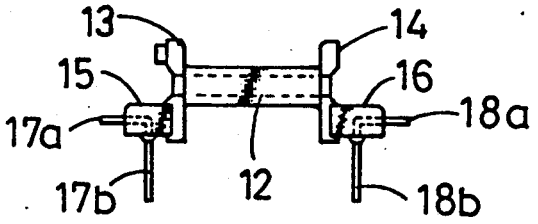
FIG. 12 is a side elevation of the coil bobbin of FIG. 10.

Referring to FIGS. 1 and 2, there is shown a thin type transformer according to the present invention, which transformer includes a coil bobbin 11 formed preferably by means of an injection molding of a synthetic resin, and provided with a flat and hollow barrel part 12 of an angulate cylinder and with flange parts 13 and 14 formed at each axial end of the barrel part 12, while thickened terminal carrying parts 15 and 16 are provided on a lower portion of the both flange parts 13 and 14 to extend in parallel directions transverse to the axis of the coil bobbin. The thickened terminal carrying parts 15 and 16 are provided respectively to have a plurality of terminals 17 or 18 made of an L-shaped conducting material and embedded in the parts 15 and 16 mutually spaced by optimum intervals (see also FIGS. 10 and 11). These terminals 17 and 18 extend at their one projecting end portions **17*a* and 18*a* in the axial direction of the coil bobbin 11 out of both end faces 15*a* and 16*a* of the thickened terminal carrying parts 15 and 16 of the respective flanges 13 and 14, while other end portions 17*b* and 18*b* of the terminals 17 and 18 project downward out of the bottom face of the both thickened parts 15 and 16 (see also FIGS. 10 and 12). Further, in the thickened terminal carrying parts 15 and 16 of the flange parts 13 and 14, there are formed lead wire guiding grooves 15*b* and 16*b* (FIG. 2) at positions between the respective terminals 17 and 18, and leading ends of a coil 19 wound on the coil bobbin 11 are connected to the one end portions 17*a* and 18*a* of corresponding one of the terminals 17 and 18 through corresponding one of the guide prooves 15*b* and 16*b***.

The thin type transformer further includes a core of a magnetic material, and this core comprises, in the embodiment shown, an E-shaped core part 20 and an I-shaped core part 21, which are formed respectively by a stack of laminates. The E-shaped core part 20 comprises a pair of side leg portions **20*a* and 20*b*, central leg portion 20*c* and a base portion 20*d* which is coupling the respective leg portions to one another, so that the central leg portion 20c will be inserted axially through the hollow barrel part 12 of the coil bobbin 11 and respective tip ends of the three leg portions 20a, 20b and 20c will be butted to one side edge of the I-shaped core part 21 on the side of the flange 14. The peripheral parts of this core are covered by a cover comprising a pair of U-shaped core cover members 22 and 23 which are formed of a synthetic resin to be mutually coupled to be integral. These core cover members 22 and 23 respectively comprise a base portion 22a or 23a and a pair of arm portions 22b and 22c or 23b and 23c, while the both core cover members 22 and 23 have a sufficient height at their outer wall portions 22d and 23d to extend down to a position corresponding to the lower surface of the thickened parts 15 and 16 of the coil bobbin 11**.

Figure 5:
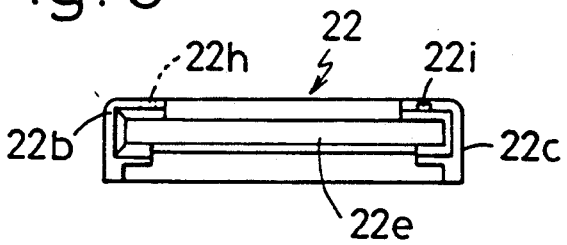
FIG. 5 is an elevation at an end face of one of the core cover members in the transformer of FIG. 1.
Figure 6:
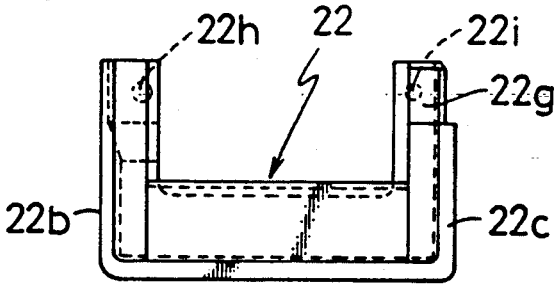
FIG. 6 is a bottom plan view of the core cover member of FIG. 5.
Figure 7:
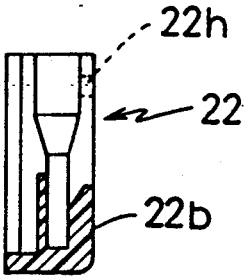
FIG. 7 is a cross sectioned view of the core cover member of FIG. 5.
Figure 8:
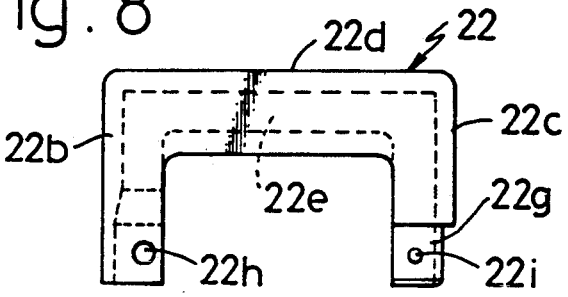
FIG. 8 is a top plan view of the core cover member of FIG. 5.
Figure 9:
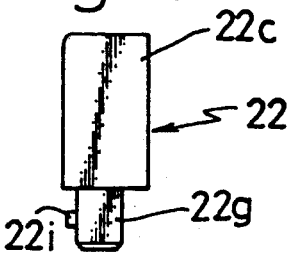
FIG. 9 is a side elevation of the core cover member of FIG. 5.

In the present instance, as will be clear specifically when FIG. 5 is also referred to, the core cover members 22 and 23 are formed to be provided respectively with an E-shaped channel 22e or 23e for engaging therein the peripheral parts of the core, that is, respective edge portions of the both side leg portions 20a and 20b of the E-shaped core part 20 and of the I-shaped core part 21, and end wall portions of the outer wall portions 22d and 23d are formed to define recessed spaces 22f and 23f in cooperation with the end faces 15a and 16a of the thickened parts 15 and 16 of the coil bobbin 11, for receiving wherein the one end portions 17a and 18a of the terminals 17 and 18. As will be clear when FIGS. 6 to 9 are also referred to, the core cover members 22 and 23 are formed to be mutually coupled to be integrally flush with each other at their tip ends, such that their first arm portions 22b and 23b allow stepped end portions 22g and 23g of the second arm portions 22c and 23c to be engaged therein. Further, the first arm portions 22b and 23b are formed at their tip ends to have engaging holes 22h and 23h while the stepped end portions 22g and 23g of the second arm portions 22c and 23c are provided with stubs 22i and 23i, so that, when each of the stepped end portions 22g and 23g is engaged in corresponding one of the tip ends of the first arm portions 22b and 23b from the state of FIG. 3 to that of FIG. 4, the stubs 22i and 23i of the stepped end portions 22g and 23g will be engaged in the engaging holes 22h and 23h of the first arm portions 22b and 23b.

Referring next to the assembly steps, the E-shaped core part 20 is first incorporated into the coil bobbin 11 on the angulate cylindrical barrel part 12 of which the coil 19 is wound between the both end flanges 13 and 14, with the central leg portion 20c of the core part 20 inserted through the barrel part 12, and then the I-shaped core part 21 is coupled preferably by means of welding to the tip ends of the both side leg portions 20a and 20b and of the central leg portion 20c. Next, one core cover member 22 is mounted onto the core by engaging the respective edge parts of the side leg portions 20a and 20b and of the base portion 20d of the E-shaped core member 20 into the channel 22e of the core cover member 22. Then, the other core cover member 23 is fitted to the thus mounted core cover member 22 at the tip end portion of the both arm portions 22b, 23b and 22c and 23c, by engaging the edge parts of the I-shaped core part 21 and of tip end parts of the both side leg parts 20a and 20b of the E-shaped core part 20 into the channel 23e of the core cover member 23, and engaging at the same time the stubs 22i and 23i of the stepped end portions 22g and 23g of the second arm portions 22c and 23c into the engaging holes 22h and 23h of the first arm portions 22b and 23b of the respective core cover members 22 and 23. The thin type transformer is thereby assembled.

In assembling it may be also possible to carry out the assembling by preliminarily mounting the E-shaped core part 20 into the channel 22e of the one core cover member 22 while preliminarily mounting the I-shaped core part 21 into the channel 23e of the other core cover member 23.

Now, it should be appreciated that, in the thin type transformer assembled in the foregoing manner, a sufficient creepage distance can be secured between the core and the terminals 17 and 18 in addition to the creepage distance between the coil 19 and the core. In particular, in the thin type transformer according to the present invention, as shown in FIG. 1, the distance can be attained simultaneously with the completion of the assembling, since lower partitions 22j and 23j defining the channels 22e and 23e of the core cover members 22 and 23 are inserted between the core and the coil bobbin 11 on the top face of the thickened terminal carrying parts 15 and 16 of the coil bobbin. This provides relatively widely expanding abutment surfaces of the thickened terminal carrying parts 15 and 16 of the coil bobbin 11 and the partitions 22j and 23j of the core cover members 22 and 23 separating the core from the terminals 17 and 18.

Further, the one end portions 17a and 18a at which the terminals 17 and 18 are to be connected to the coil 19 are disposed within the recessed spaces 22f and 23f defined between the end faces 15a and 16a of the thickened coil carrying parts 15 and 16 of the coil bobbin 11 and the end wall portions of the outer wall portions 22d and 23d of the core cover members 22 and 23, so that the connections of the terminals to the coil 19 can be sufficiently protected and any disconnection between the terminals 17 and 18 with the coil 19 can be effectively prevented from occurring.

With such mutual coupling of the core cover members 22 and 23 attained eventually through the foregoing manner, the assembling of the thin type transformer of the present invention can be completed.

What is claimed is:

1. A thin type transformer comprising a coil bobbin formed of an insulating material and having a flat and hollow barrel part and a pair of flanges at both axial ends of the barrel part, the coil bobbin having a pair of parallel terminal carrying parts at lower portions of the flanges, terminals mounted in the terminal carrying parts having projecting end portions, a coil wound on the barrel part and between the flanges, a core having a central leg portion inserted axially through the barrel part of the coil bobbin, and a pair of U-shaped core cover members each formed of an insulating material and including a base portion perpendicular to the core leg portion and opposite arm portions extending parallel to the core leg portion, the arm portions of the cover members being butted to each other and having mutually interposed coupling means, the cover members being respectively provided with a channel receiving therein peripheral parts of the core, the channel in each of the cover members being defined by a top wall and a lower partition which is inserted on a top face of an adjacent terminal carrying part of the coil bobbin between the core and the terminal end portions of the coil bobbin, whereby the projecting end portions of the terminals are separated from the core by the lower partitions of the cover members.

2. The transformer according to claim 1 wherein the core cover members are respectively provided substantially in symmetrical relationship to each other and the coupling means comprises an engaging hole provided in tip end portions of first of the pair of arm portions, and a stub provided in tip end portions of second of the pair of arm portions for engaging in the hole in each of the core cover members.

3. The transformer according to claim 1 wherein the terminals are substantially L-shaped and the projecting end portions of the terminals extend parallel to the central leg of the core for connection with leading ends of the coil, and other projecting end portions of the terminals being projected project downward from a lower surface of the terminal carrying parts of the coil bobbin.

4. The transformer according to claim 1 wherein recessed spaces are defined below the lower partition of each of the core cover members and between an inner surface of an outer wall of an adjacent core cover member and an outer end surface of an adjacent terminal carrying part of the coil bobbin, the recessed spaces receiving therein the projecting end portions of the terminals.

* * * * *